US008174459B2

(12) United States Patent
Chen et al.

(10) Patent No.: US 8,174,459 B2
(45) Date of Patent: May 8, 2012

(54) COPLANAR ANTENNA UNIT AND COPLANAR ANTENNA

(75) Inventors: Fu-Chiarng Chen, Hsinchu (TW); Cheng-Lung Kao, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 440 days.

(21) Appl. No.: 12/603,845

(22) Filed: Oct. 22, 2009

(65) Prior Publication Data

US 2011/0037675 A1 Feb. 17, 2011

(30) Foreign Application Priority Data

Aug. 14, 2009 (TW) ..... 98127509 A

(51) Int. Cl.

| | |
|---|---|
| ***H01Q 1/48*** | (2006.01) |
| ***H01Q 1/38*** | (2006.01) |
| ***H01Q 5/00*** | (2006.01) |
| ***H01Q 9/04*** | (2006.01) |

(52) U.S. Cl. ..... 343/848; 343/700 MS; 343/846; 343/845

(58) Field of Classification Search ..... 343/847–9
See application file for complete search history.

(56) References Cited

U.S. PATENT DOCUMENTS

| | | | | |
|---|---|---|---|---|
| 5,420,596 | A * | 5/1995 | Burrell et al. | 343/700 MS |
| 5,760,746 | A * | 6/1998 | Kawahata | 343/702 |
| 6,281,848 | B1 * | 8/2001 | Nagumo et al. | 343/700 MS |
| 6,476,767 | B2 * | 11/2002 | Aoyama et al. | 343/700 MS |
| 6,700,543 | B2 * | 3/2004 | Konishi et al. | 343/700 MS |
| 6,753,813 | B2 * | 6/2004 | Kushihi | 343/700 MS |
| 6,891,507 | B2 * | 5/2005 | Kushihi et al. | 343/702 |
| 2010/0315303 | A1 * | 12/2010 | Kearney et al. | 343/767 |
| 2011/0210898 | A1 * | 9/2011 | Choi et al. | 343/749 |
| 2011/0227806 | A1 * | 9/2011 | Wong et al. | 343/848 |
| 2012/0001815 | A1 * | 1/2012 | Wong et al. | 343/749 |

* cited by examiner

*Primary Examiner* — Douglas W Owens
*Assistant Examiner* — Jennifer F Hu
(74) *Attorney, Agent, or Firm* — WPAT, P.C.; Anthony King

(57) ABSTRACT

The present invention is related to a coplanar antenna unit and a coplanar antenna. By utilizing the unique properties of meta-material to design 1-D balanced CRLH leaky-wave antenna. The antenna can be realized with the coplanar antenna unit consisting of MIM capacitor and grounded inductor. In this invention, all proposed elements are implemented by planar print circuit broad, so the full-space switched beam scanning antenna has shorter length of leaky-wave antenna and good radiation performance.

22 Claims, 8 Drawing Sheets

(a)2.75GHz (b)3.5GHz (c)3.9GHz

COPLANAR ANTENNA UNIT AND COPLANAR ANTENNA

BACKGROUND OF THE INVENTION

1. Field of the Invention

The present invention relates to a coplanar antenna unit and a coplanar antenna, in particular to a coplanar antenna unit of a leaky-wave antenna and a coplanar antenna of a leaky-wave antenna.

2. Description of the Related Art

Leaky-wave antenna has a significant contribution to the development of wireless systems. Antenna capable of integrating a composite right/left-handed (CRLH) material with wireless communications is one of the popular research subjects in recent years. Therefore, a composite right/left-handed (CRLH) structure is one of the best techniques used in these popular applications. At present, methods of designing a leaky-wave antenna are mainly divided into the following types:

1. Using a periodic structure: A periodic structure such as a dielectric grid, a metal plate grid and a groove grid of a metal plate is formed by a space harmonic wave produced by a periodical effect.

2. Using an opening waveguide: An opening waveguide such as a corrugated waveguide, a non-radiation medium waveguide and a micro strip is operated at a high-order mode to achieve the functions of a leaky-wave antenna.

3. Integrating with a meta-material: Both radiation region and waveguide region are provided in a general mode, such that when the operating frequency falls within the radiation region, a leaky-wave antenna is achieved.

Although the prior art can achieve the effect of a leaky-wave antenna, most energies in the structure are leaked to the space to achieve high gain and antenna efficiency. To achieve this effect, manufacturers use a leaky-wave antenna made of a periodic structure, an opening waveguide or a meta-material with a sufficient length to transmit a large portion of energies into the space. To cope with the mainstream of miniaturization and meet the requirements of an integrated communication system, it is very important to minimize the volume of the leaky-wave antenna.

SUMMARY OF THE INVENTION

Therefore, it is a primary objective of the present invention to overcome the shortcomings of the prior art by providing a coplanar antenna unit and a coplanar antenna and designing a miniaturized CLRH leaky-wave antenna. For a communication system, such antenna can be integrated easily with a wireless communication application to improve the development of integrated communication systems in the wireless communication industry and promote the future communication technologies.

To achieve the foregoing objective, the present invention provides a coplanar antenna unit, comprising a substrate, a radiation plane, a first ground plane, a second ground plane and a metal plate. The radiation plane is disposed on a first side of the substrate, and includes a feed plane and an output plane. The feed plane is provided for receiving a feed-in signal, and the feed-in signal generates a radiation signal at the feed plane. The output plane has an interval from the feed plane, and the radiation signal is coupled to the output plane, such that the output plane may output a radiation signal, and the output plane includes a first extension portion and a second extension portion. The first ground plane is disposed on the first side of the substrate and situated on a first side of the radiation plane, and the first ground plane has a first hollow portion, and the first extension portion disposed in the first hollow portion, and an end of the first extension portion is coupled to the first ground plane. The second ground plane is disposed on the first side of the substrate and situated on a second side of the radiation plane, and the second ground plane has a second hollow portion at a position corresponding to the first hollow portion, and the second extension portion is disposed in the second hollow portion, and an end of the second extension portion is connected to the second ground plane. The metal plate is disposed on a second side of the substrate and the metal plate is disposed corresponding to the radiation plane.

A capacitor structure is formed by the radiation plane and the metal plate, and the capacitor structure defines an equivalent left handed capacitor.

A metal-insulator-metal (MIM) capacitor structure is formed by the radiation plane, the substrate and the metal plate.

A plurality of coplanar antenna units are coupled in series to form a coplanar antenna.

The coplanar antenna unit has a balanced frequency determined by the size of the first extension portion, the second extension portion or the metal plate.

The via structures are disposed onto the feed plane and the metal plate respectively, and the positions of the via structures on the feed plane are corresponding to the positions of the via structures of the metal plate.

The metal plate is in a square, triangular, circular, pentagonal or hexagonal shape.

The first extension portion or second extension portion defines an equivalent circuit of a left handed inductor.

Another objective of the present invention is to provide a coplanar antenna, comprising a plurality of coplanar antenna units connected with each other in series, and each of the plurality of coplanar antenna units comprises: a substrate, a radiation plane, a first ground plane, a second ground plane and a metal plate. The radiation plane is disposed on a first side of the substrate, and includes a feed plane and an output plane. The feed plane is provided for receiving a feed-in signal, and the feed-in signal generates a radiation signal at the feed plane. The output plane has an interval from the feed plane, and the radiation signal is coupled to the output plane, such that the output plane may output a radiation signal, and the output plane includes a first extension portion and a second extension portion. The first ground plane is disposed on the first side of the substrate and situated on the first side of the radiation plane, and the first ground plane has a first hollow portion, and the first extension portion is disposed in the first hollow portion, and an end of the first extension portion is coupled to the first ground plane. The second ground plane is disposed on a side of the substrate and situated on another side of the radiation plane, and the second ground plane has a second hollow portion at a position corresponding to the first hollow portion, and the second extension portion is disposed in the second hollow portion, and an end of the second extension portion is connected to the second ground plane. The metal plate is disposed on a second side of the substrate and the metal plate is disposed corresponding to the radiation plane.

A capacitor structure is formed by the radiation plane and the metal plate, and the capacitor structure defines an equivalent left handed capacitor.

A metal-insulator-metal (MIM) capacitor structure is formed by the radiation plane, the substrate and the metal plate.

The plurality of coplanar antenna units are serially coupled.

The coplanar antenna unit has a balanced frequency determined by the size of the first extension portion, the second extension portion or the metal plate.

The via structures are disposed onto the feed plane and the metal plate respectively, and the positions of the via structures on the feed plane are corresponding to the positions of the via structures of the metal plate The metal plate is in a square, triangular, circular, pentagonal or hexagonal shape.

The first extension portion or second extension portion defines the equivalent circuit of a left handed inductor.

Four or more coplanar antenna units are serially coupled.

The coplanar antenna formed by coupling five coplanar antenna units in series has a leak energy quantity of 90%.

The coplanar antenna formed by coupling five coplanar antenna units in series has a balanced frequency of 3.5 GHz.

To achieve another objective, the present invention provides a coplanar antenna unit and a coplanar antenna, and designs a miniaturized leaky-wave antenna to achieve an application integrated with the wireless communication easily, so as to overcome the problem of the conventional CRLH leaky-wave antenna having a long structure for the radiation of energy. The concept of miniaturizing the CLRH leaky-wave antenna may be applied to other frequencies in other communication specifications. The miniaturization may meet the requirements of a wireless communication system and an integrated communication system in the future.

In summation, the coplanar antenna unit and the coplanar antenna of the present invention have one or more of the following advantages:

(1) The coplanar antenna unit and the coplanar antenna have a frequency sweep property, and are capable of performing a continuous scanning from backward to broadside and then to forward, with two main beam directions.

(2) The coplanar antenna unit and the coplanar antenna adopt the metal-insulator-metal capacitor made and the grounded inductor made of a meta-material to design serially connected capacitors and parallely connected inductors made of a left handed material respectively.

(3) The coplanar antenna unit and the coplanar antenna use the coplanar waveguide and the metal-insulator-metal capacitor having a larger capacitance in the same area to overcome the issue of the prior art having a low leakage constant.

(4) The coplanar antenna unit and the coplanar antenna use another layer of a coplanar waveguide to achieve the effect of a metal-insulator-metal capacitor without requiring additional substrate in order to achieve a low profile.

DETAILED DESCRIPTION OF THE PREFERRED EMBODIMENTS

The technical characteristics of the present invention will become apparent with the detailed description of the following preferred embodiments and related drawings.

Figure 1:
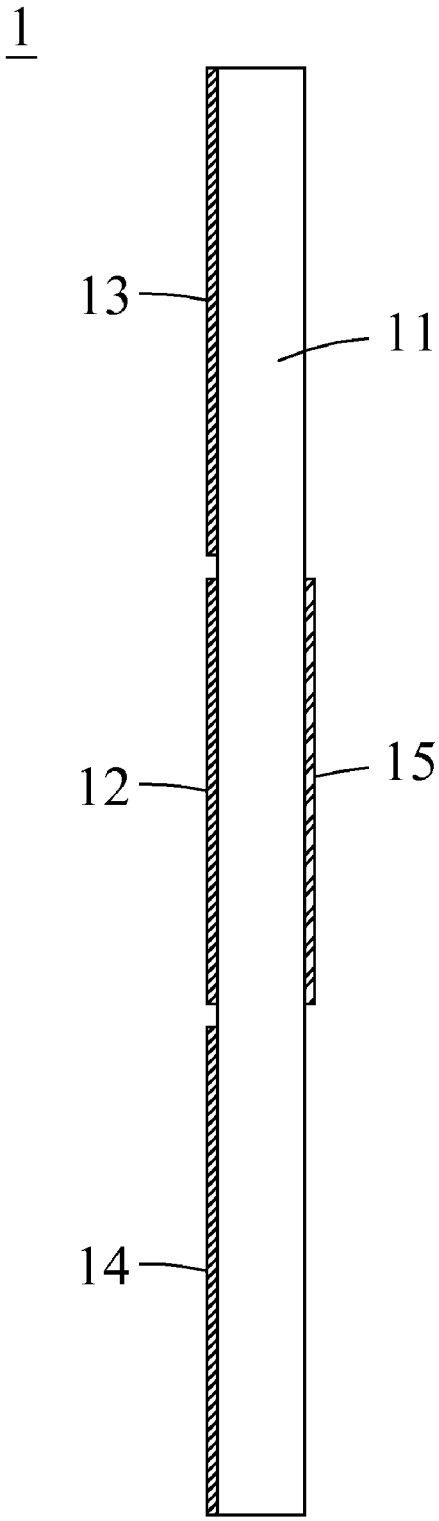
FIG. 1 is a side view of a coplanar antenna unit of the present invention.

With reference to FIG. 1 for a side view of a coplanar antenna unit of the present invention, the coplanar antenna unit 1 comprises a substrate 11, a radiation plane 12, a first ground plane 13, a second ground plane 14 and a metal plate 15. The radiation plane 12, first ground plane 13 and second ground plane 14 are disposed on the first side of the substrate 11, and the metal plate 15 is disposed on the second side of the substrate and at a position corresponding to the radiation plane 12.

Figure 2:
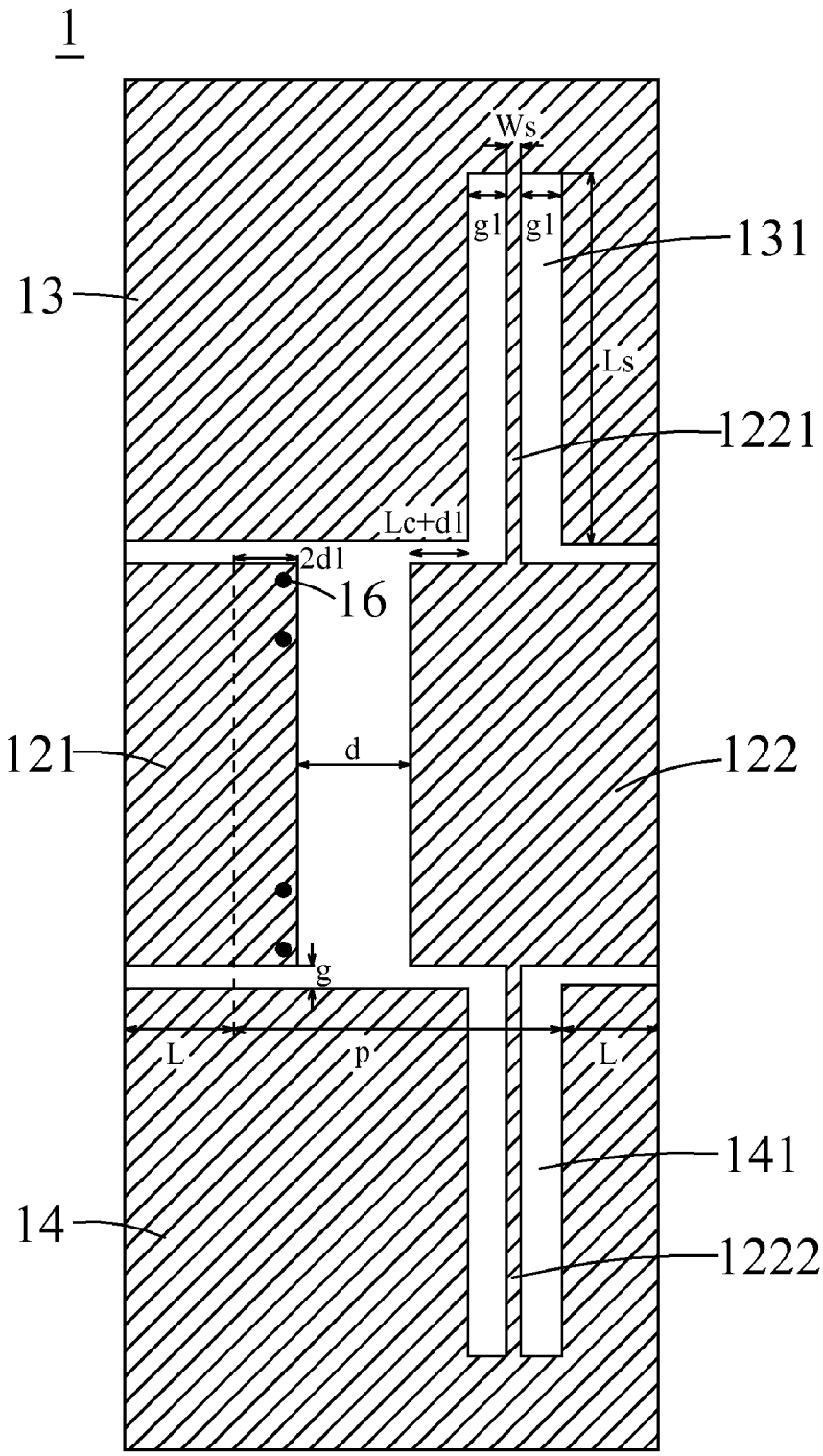
FIG. 2 is a top view of a coplanar antenna unit of the present invention.
Figure 3:
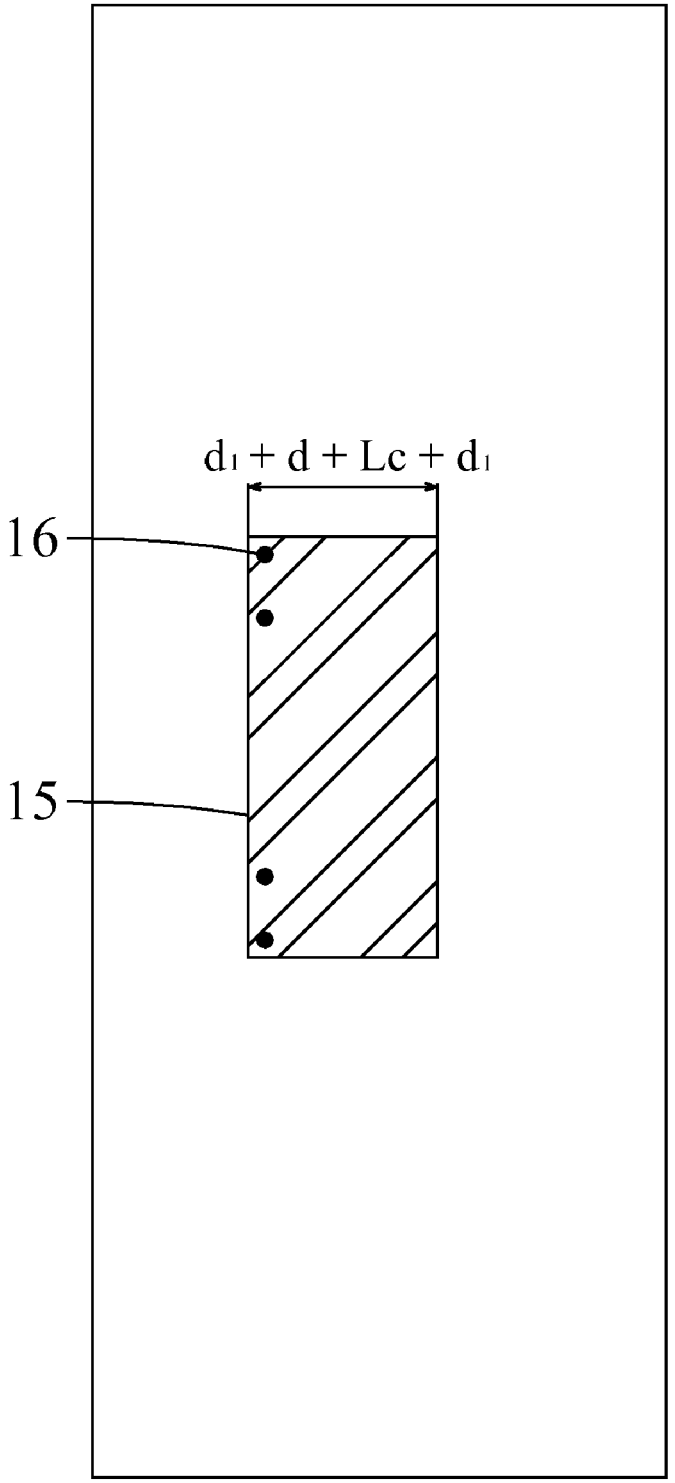
FIG. 3 is a bottom view of a coplanar antenna unit of the present invention.

With reference to FIGS. 2 and 3 for a top view and a bottom view of a coplanar antenna unit of the present invention respectively, the radiation plane 12 includes a feed plane 121 and an output plane 122. The feed plane 121 is provided for receiving a feed-in signal, and a radiation signal is generated according to the feed-in signal at the feed plane 121. If the feed-in signal at the feed plane 121 has accumulated radiation energies to a certain extent to generate radiation signals at an edge of the feed plane 121. The output plane 13 has an interval d from the feed plane 121, and thus the radiation signal is coupled to the output plane 122, such that the output plane 122 may output the radiation signals. The output plane 122 includes a first extension portion 1221 and a second extension portion 1222. The first ground plane 13 is disposed on the first side of the radiation plane 12, and the first ground plane 13 has a first hollow portion 131. The second ground plane 14 is disposed on the second side of the radiation plane 12, and the second ground plane includes a second hollow portion 141 corresponding to the first hollow portion 131. The first extension portion 1221 is disposed in the first hollow portion 131, and an end of the first extension portion 1221 is coupled to the first ground plane 13, and the second extension portion 1222 is disposed in the second hollow portion 141, and an end of the second extension portion 1222 is coupled to the second ground plane 14.

If the radiation plane 12 is disposed on the first side of the substrate 11, and the metal plate 15 is disposed on the second side of the substrate 11, and the substrate 11 is made of a dielectric material, we will find that the structure is a MIM structure, and thus the equivalent circuit is a MIM capacitor. In a preferred embodiment, a RogersRT/Duriod5880 substrate is used, and this substrate has a dielectric constant of 2.2 and a loss tangent of 0.0009, indicating a very low loss.

The feed plane 121 and the metal plate 15 have vias 16 disposed thereon and corresponding to each other, and thus the feed-in signals may be transmitted to the metal plate 15 through the vias 16. In this preferred embodiment, four vias are used, but not limited to such arrangement only, and the balanced frequency will be affected by the number of the vias and size of the vias. The equivalent circuit formed by the radiation plane 12 and the metal plate 15 is a capacitor structure. If both radiation plane 12 and metal plate 15 are made of meta-materials, this capacitor structure has a left handed property, and is called a left handed capacitor.

The output plane 122 includes a first extension portion 1221 and a second extension portion 1222, whose equivalent circuit is an inductor, such that the size of the first extension portion 1221 and the second extension portion 1222 may be adjusted to change the properties of the coplanar antenna unit 1. If the output plane 122 is made of a meta-material, the inductor of the output plane 22 has the left handed properties, and thus the equivalent circuit has a left handed inductor thereon.

The coplanar antenna unit 1 has a balanced frequency determined by the size of the first extension portion 1221, the second extension portion 1222 or the metal plate 15. In FIG. 2, the width of the first extension portion 1221 and the second extension portion 1222 is Ws. Similarly, the size of the hollow portion is affected by the length and width of the first extension portion 1221 and the second extension portion 1222, and the balanced frequency may be determined by changing the size of length and width (Ls, Ws) of the hollow portion. The balanced frequency may be changed according to the size of the metal plate, the length and width (such as $d_1$, d, Lc) and the geometric shape. The metal plate 15 may be in a square, triangular, circular, pentagonal or hexagonal shape. The invention is not limited to these shapes only, but any other geometric shape can be used.

Figure 4:
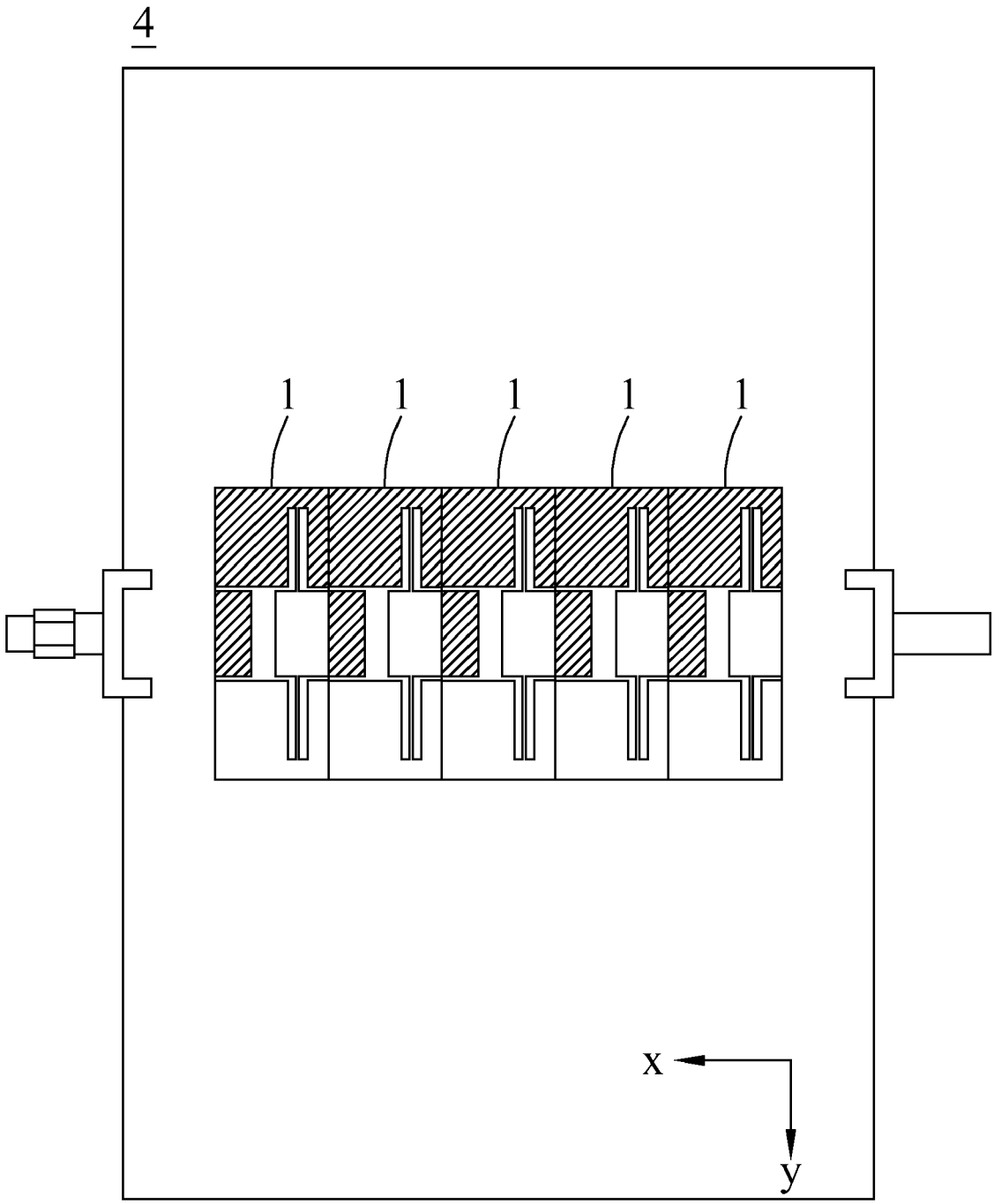
FIG. 4 is a top view of a coplanar antenna of the present invention.
Figure 5:
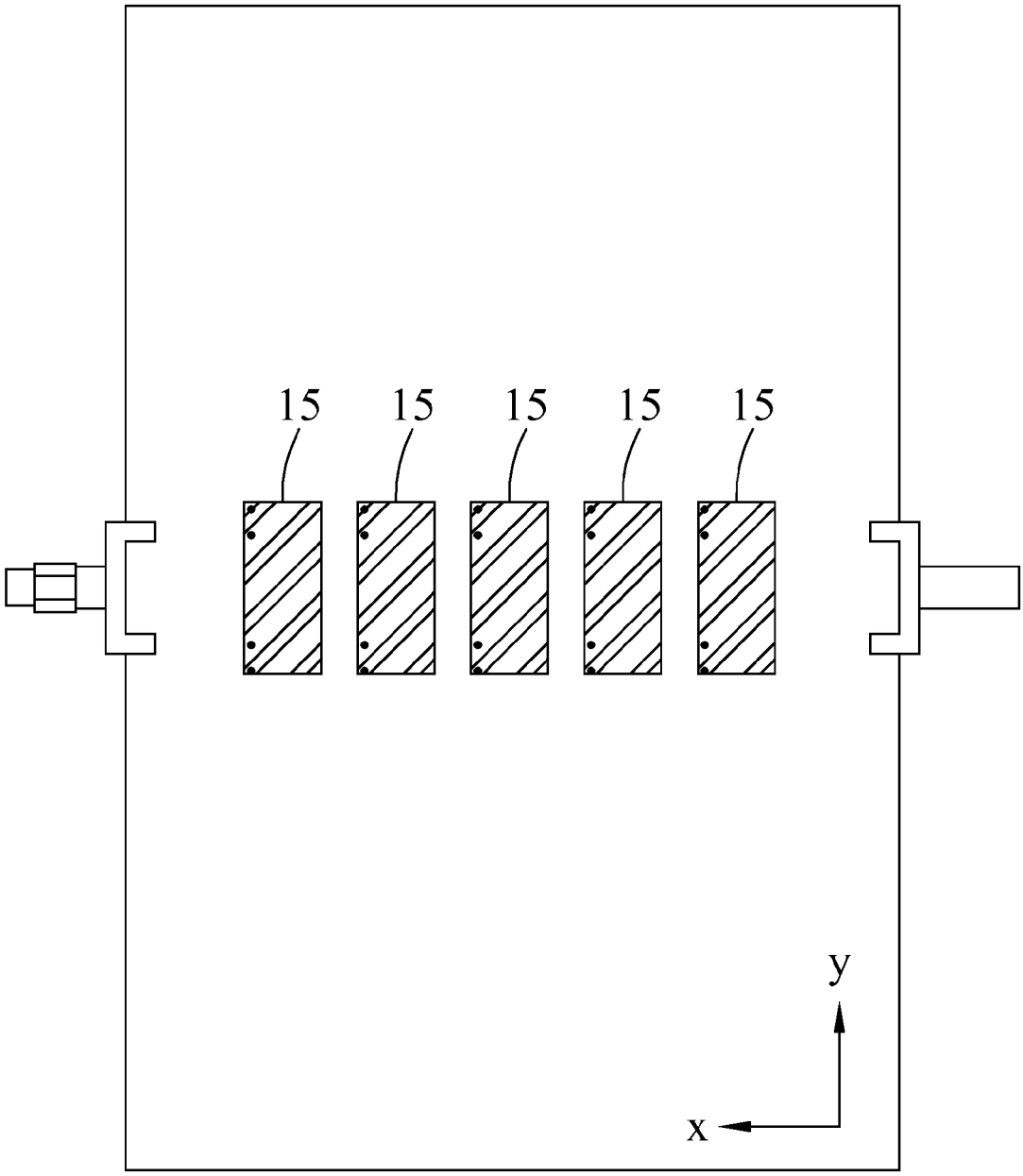
FIG. 5 is a bottom view of a coplanar antenna of the present invention.

With reference to FIGS. 4 and 5 for a top view and a bottom view of a coplanar antenna of the present invention respectively, the coplanar antenna 4 includes five coplanar antenna units connected with each other in series, and the coplanar antenna units have been described above, and will not be described here again. The coplanar antenna further includes a sub miniature version A (SMA) connector for connecting the first coplanar antenna unit with a feed-in signal through the SMA connector, and outputting a radiation signal through the last coplanar antenna unit through the SMA connector.

Figure 6:
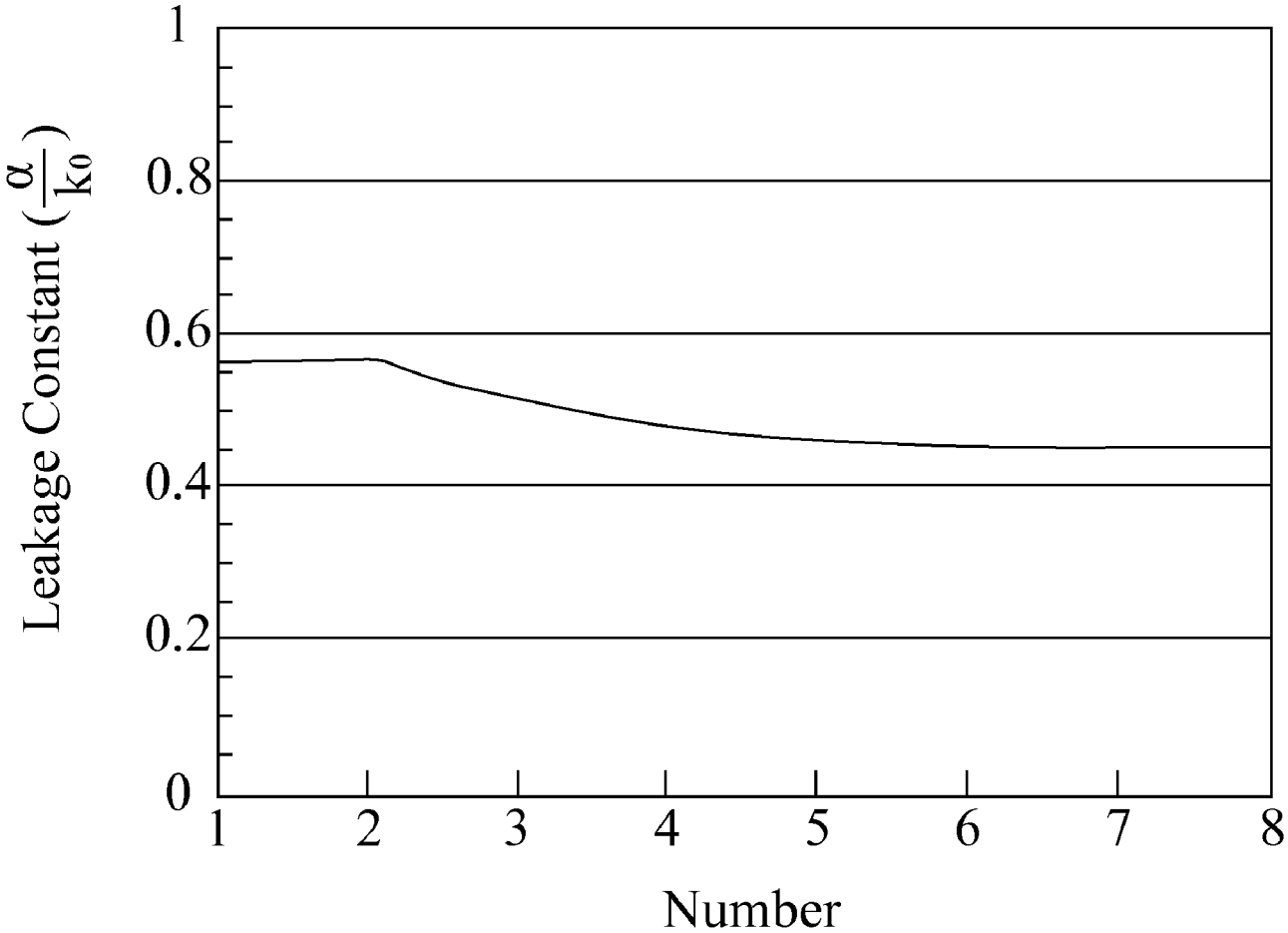
FIG. 6 is a graph of leakage constant versus number of coplanar antenna units of the present invention.

With reference to FIG. 6 for a graph of leakage constant versus number of coplanar antenna units of the present invention, the leakage constant tends to be convergent if the balanced frequency is 3.5 GHz, and the ratio of remaining energy at an end to energy at an output terminal is less than 0.1, and four or more coplanar antenna units are connected with each other in series. Therefore, a coplanar antenna having four or five coplanar antenna units is a better choice.

Figure 7:
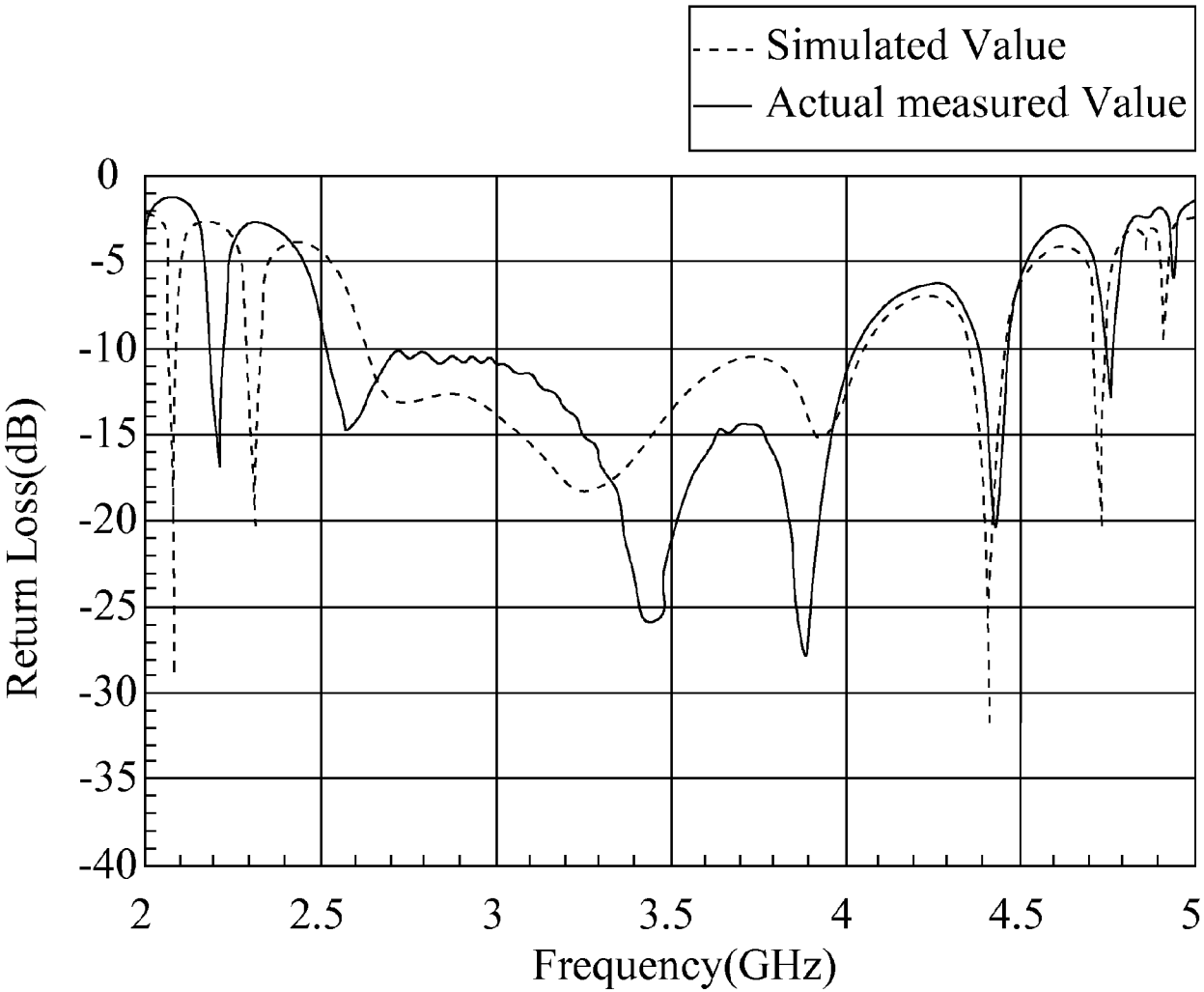
FIG. 7 is a graph of return loss versus frequency response of the present invention.

With reference to FIG. 7 for a graph of return loss versus frequency response of the present invention, two curves are shown in the graph, wherein one curve shows a simulated value, and the other curve is an actual measured value. If the operating frequency is 3.5 GHz, then the return loss is approximately −26 dB. If the operating frequency is 3.9 GHz, then the return loss is approximately −29 dB.

Figure 8:
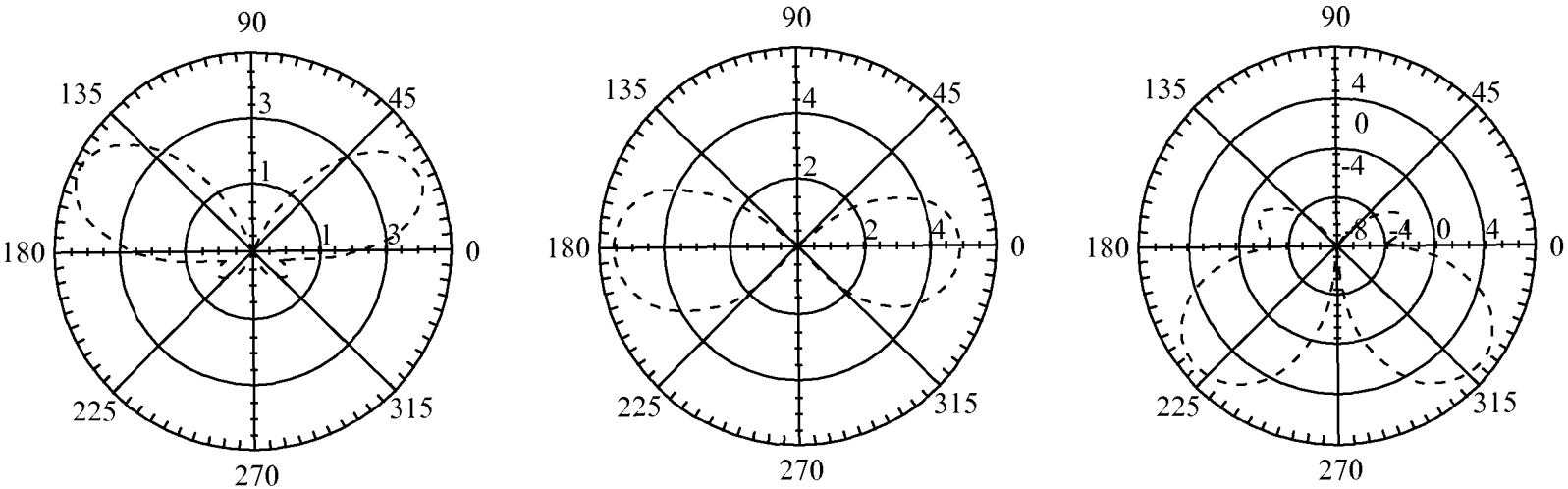
FIG. 8 is a schematic view of simulations of far field radiation patterns on the X-Z plane of a coplanar antenna in accordance with the present invention.

With reference to FIG. 8 for a schematic view of simulations of far field radiation patterns on the X-Z plane of a coplanar antenna in accordance with the present invention, the operating frequencies are 2.75 GHz, 3.5 GHz and 3.9 GHz. If the operating frequency is 2.75 GHz, the antenna is operated within a left handed leak wave region, and main beam directions are 24° and 155°, and gain values are 4.5 dBi and 4.8 dBi respectively. If the operating frequency is 3.5 GHz, the antenna is operated at a leak wave region at a balanced frequency, and the simulated main beam directions are −1° and 179°, and gain values are 4.9 dBi and 5.6 dBi respectively. If the operating frequency is 3.9 GHz, the antenna is operated at a right handed leak wave region, and main beam directions are −39° and −142°, the simulated gain values are 7 dBi and 7.1 dBi respectively.

If the operating frequencies of the present invention are 2.75 GHz, 3.5 GHz and 3.9 GHz, the main beam directions under the substrate are 155°, 179° and −142° respectively, and the main beam directions above the substrate are 24°, −1° and −39° respectively, show a frequency sweep property, which is a unique property of a leaky-wave antenna, and thus we are sure that the antenna is a leaky-wave antenna, caused by the radiation property of the CLRH inductor, whose total scanning angle is 63°, and the total scanning angle above the substrate is 63°.

The present CRLH leaky-wave antenna and the conventional leaky-wave antenna have a length of 4~5 wavelength, due to a low leakage constant, and a miniaturized CLRH leaky-wave antenna of the present invention is designed according to such requirement, so as to produce the coplanar antenna of the present invention. The aforementioned applications adopt a micro-strip structure, so that the leakage constant is low, since there is only one radiation plane, and most of the energies are stored in the media and cannot be leaked to the space. Therefore, the coplanar antenna unit (or unit cell) of the present invention has the property of a higher leakage constant.

The coplanar antenna unit uses a coplanar waveguide (CPW) inductor structure and the coplanar antenna unit having a shorter overall electric length to achieve the higher leakage constant. Due to the higher leakage constant of the coplanar antenna unit, the serially or parallely connected resistors in the equivalent circuit cannot be ignored. The coplanar antenna of the present invention aims at the objective of achieving a high leakage constant, and overcoming the drawback of having a too-long CRLH leaky-wave antenna by the coplanar waveguide and the MIM capacitor.

What is claimed is:

1. A coplanar antenna unit, comprising:

a substrate;

a radiation plane disposed on a first side of the substrate, and comprising:

a feed plane receiving a feed-in signal, and the feed-in signal generating a radiation signal at the feed plane; and an output plane having an interval from the feed plane, and the radiation signal being coupled to the output plane, and the output plane outputting the radiation signal, and the output plane including a first extension portion and a second extension portion;

a first ground plane disposed on the first side of the substrate, and situated on a first side of the radiation plane, and the first ground plane having a first hollow portion, and the first extension portion being disposed in the first hollow portion, and an end of the first extension portion being coupled to the first ground plane;

a second ground plane disposed on the first side of the substrate, and situated on a second side of the radiation plane, and the second ground plane having a second hollow portion disposed at a position corresponding to the first hollow portion, and the second extension portion being disposed in the second hollow portion, and an end of the second extension portion being coupled to the second ground plane; and a metal plate disposed on a second side of the substrate, and the metal plate being disposed corresponding to the radiation plane.

2. The coplanar antenna unit of claim 1, wherein a capacitor structure is formed by the radiation plane and the metal plate.

3. The coplanar antenna unit of claim 2, wherein the capacitor structure defines an equivalent left handed capacitor.

4. The coplanar antenna unit of claim 1, wherein a metal-insulator-metal (MIM) capacitor structure is formed by the radiation plane, the substrate and the metal plate.

5. The coplanar antenna unit of claim 1, wherein a plurality of the coplanar antenna units are coupled in series to form a coplanar antenna.

6. The coplanar antenna unit of claim 1, wherein the coplanar antenna unit has a balanced frequency determined by the size of the first extension portion, the second extension portion or the metal plate.

7. The coplanar antenna unit of claim 1, wherein via structures are disposed onto the feed plane and the metal plate respectively, and positions of the via structures on the feed plane are corresponding to positions of the via structures of the metal plate.

8. The coplanar antenna unit of claim 1, wherein the metal plate is in a square, triangular, circular, pentagonal or hexagonal shape.

9. The coplanar antenna unit of claim 1, wherein the first extension portion or the second extension portion defines an equivalent circuit of an inductor.

10. The coplanar antenna unit of claim 9, wherein the inductor is a left handed inductor.

11. A coplanar antenna, comprising a plurality of coplanar antenna units coupled in series, and each of the plurality of coplanar antenna units comprising:

a substrate;

a radiation plane disposed on a first side of the substrate, and comprising:

a feed plane receiving a feed-in signal, and the feed-in signal generating a radiation signal at the feed plane; and an output plane having an interval from the feed plane, and the radiation signal being coupled to the output plane, and the output plane outputting the radiation signal, and the output plane including a first extension portion and a second extension portion;

a first ground plane disposed on the first side of the substrate, and situated on a first side of the radiation plane, and the first ground plane having a first hollow portion, and the first extension portion being disposed in the first hollow portion, and an end of the first extension portion being coupled to the first ground plane;

a second ground plane disposed on the first side of the substrate, and situated on a second side of the radiation plane, and the second ground plane having a second hollow portion disposed at a position corresponding to the first hollow portion, and the second extension portion being disposed in the second hollow portion, and an end of the second extension portion being coupled to the second ground plane; and a metal plate disposed on a second side of the substrate, and the metal plate being disposed corresponding to the radiation plane.

12. The coplanar antenna of claim 11, wherein a capacitor structure is formed by the radiation plane and the metal plate.

13. The coplanar antenna of claim 12, wherein the capacitor structure defines an equivalent left handed capacitor.

14. The coplanar antenna of claim 11, wherein a metal-insulator-metal (MIM) capacitor structure is formed by the radiation plane, the substrate and the metal plate.

15. The coplanar antenna of claim 11, wherein the coplanar antenna has a balanced frequency determined by the size of the first extension portion, the second extension portion or the metal plate.

16. The coplanar antenna of claim 11, wherein via structures are disposed onto the feed plane and the metal plate respectively, and positions of the via structures on the feed plane are corresponding to positions of the via structures of the metal plate.

17. The coplanar antenna of claim 11, wherein the metal plate is in a square, triangular, circular, pentagonal or hexagonal shape.

18. The coplanar antenna of claim 11, wherein the first extension portion or the second extension portion defines an equivalent circuit of an inductor.

19. The coplanar antenna of claim 18, wherein the inductor is a left handed inductor.

20. The coplanar antenna of claim 11, wherein four or more coplanar antenna units are serially coupled.

21. The coplanar antenna of claim 11, wherein the coplanar antenna formed by coupling five coplanar antenna units in series has a leak energy quantity of 90%.

22. The coplanar antenna of claim 11, wherein the coplanar antenna formed by coupling five coplanar antenna units in series has a balanced frequency of 3.5 GHz.

* * * * *